United States Patent [19]

Bowman

[11] B 3,981,222

[45] Sept. 21, 1976

[54] TIME DELAY FUSE

[75] Inventor: Donald E. Bowman, Baltimore, Md.

[73] Assignee: Catalyst Research Corporation, Baltimore, Md.

[22] Filed: Mar. 31, 1964

[21] Appl. No.: 356,187

[44] Published under the second Trial Voluntary Protest Program on January 20, 1976 as document No. B 356,187.

Related U.S. Application Data

[62] Division of Ser. No. 149,483, Oct. 30, 1961, Pat. No. 3,897,731.

[52] U.S. Cl. ..... 86/1 R; 86/22

[51] Int. Cl.[2] ..... F42B 3/10

[58] Field of Search ..... 86/1, 22; 102/27, 85

[56] References Cited

UNITED STATES PATENTS

| | | | |
|---|---|---|---|
| 2,164,509 | 7/1939 | Fleming et al. | 102/27 |
| 2,416,639 | 2/1947 | Pearsall | 102/27 |

FOREIGN PATENTS OR APPLICATIONS

| | | | |
|---|---|---|---|
| 746,843 | 3/1956 | United Kingdom | 102/27 |

*Primary Examiner*—Stephen C. Bentley
*Assistant Examiner*—Harold Tudor

EXEMPLARY CLAIM

1. A method of making a time delay fuse comprising the steps of overlaying a fuse strip consisting essentially of a paper formed of non-combustible insulating fibers filled with a combustible compositon which evolves substantially no gas on burning with a backing strip wider than said fuse strip consisting essentially of a paper formed from non-combustible insulating fibers, both ends of said fuse strip extending beyond and normal to said backing strip, winding said overlaid fuse strip in a flat spiral around the circumference of a cylindrical core formed from non-combustible insulating fibers to form a cylindrical body having said both fuse strip ends exposed on the surface of said core while maintaining a high water content in said fuse strip, backing strip and core, axially compressing said body to form a compact, and drying said compact.

3 Claims, 3 Drawing Figures

INVENTOR.
DONALD E. BOWMAN.
BY
his ATTORNEY.

TIME DELAY FUSE

This application is a Divisional Application of Ser. No. 149,483, filed Oct. 30, 1961, now U.S. Pat. No. 3,897,731.

This invention relates to fuses of the type used with explosives, in pyrotechny and for related purposes, and more particularly to time delay fuses.

Time delay fuses now generally in use comprise a metal tube enclosing a pyrotechnic material. Such fuses are often heavy and bulky, and frequently do not provide precise and reproducible time delays.

It is an object of this invention to provide a reliable and accurate time delay fuse. Another object is to provide a time delay fuse that is light and of small dimensions. A further object is to provide time delay fuses that can be simply and conveniently connected in series to provide any desired time delay. A still further object is to provide a time delay fuse in which the pyrotechnic fuse path is enclosed within a compact mass of insulating fibrous material. Other objects will be apparent from the following description and claims.

According to this invention a fuse strip is formed by coating fibers of a non-inflammable insulating material, such as glass fibers, ceramic fibers, asbestos fibers or mixtures thereof with a combustible composition which evolves substantially no gases on burning, and forming them into a cohesive matte or paper. The fuse strip is enclosed in an uncoated matte or paper of the fibrous material, and the entire assembly is compressed in a dense compact mass. The resulting compact of fibrous material thus contains a path of fibers coated with a combustible composition which is insulated from itself by the enclosing uncoated fibers. The fuse compact which is somewhat brittle, is enclosed by a container or coated with protective material and provided with an exposed ignition means and primer means connected to opposite ends of the fuse strip.

Figure 1:
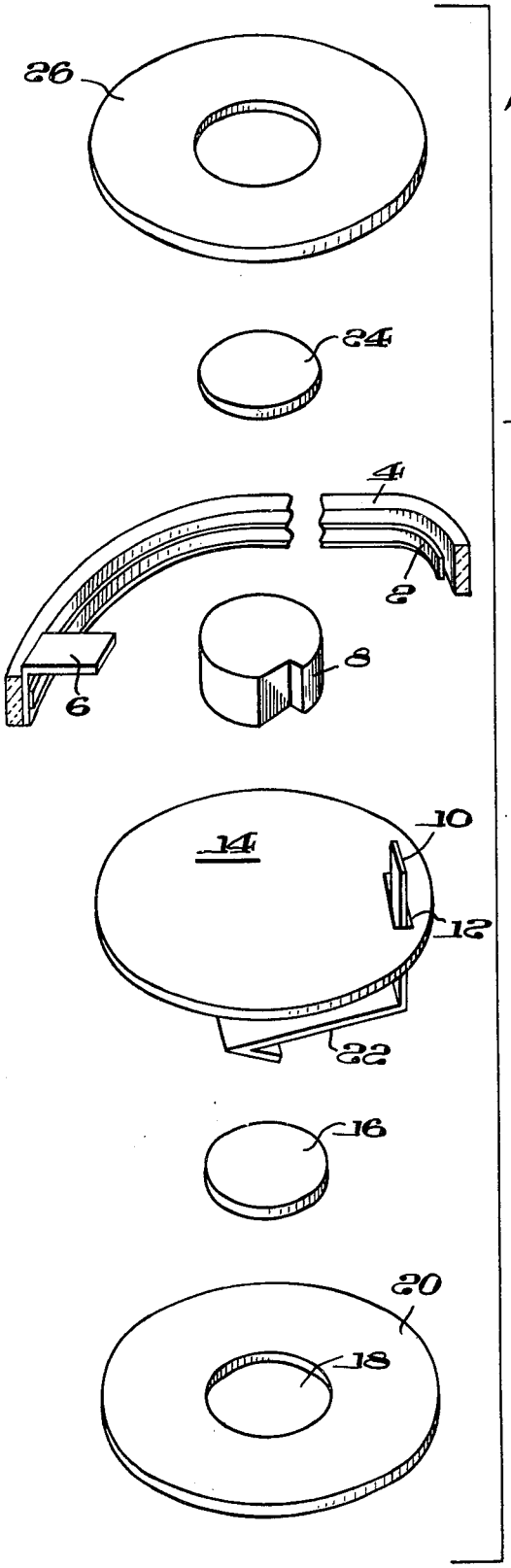
FIG. 1 is an exploded perspective view of a fuse element according to this invention.

The fuse strip of non-combustible insulating fibers coated with the combustible composition may be formed in a variety of ways that will be apparent to those skilled in the art. A most convenient method is to make a paper from the fibers using the combustible composition as a filler. That is, a slurry of the combustible composition is added and mixed with a slurry of the fiber and a filled paper is formed from the slurry mixture in a conventional manner using a Fourdinier machine, cylinder paper machine, or other conventional apparatus. The fuse strip, as well as other parts used to form the fuse compact, are maintained wet with water, suitably about 70–90% by weight water, throughout all processing steps until compacted to facilitate handling and forming and to prevent accidental ignition of the protechnic. If preferred, the fuse strip may be formed in layers of unfilled and combustible composition filled paper.

The fibrous material must be non-combustible and have a low heat conductivity such as glass fibers, asbestos fibers, or ceramic fibers. It is preferred to use fine, flexible fibers as the paper produced therefrom is most flexible and more easily compressed to a dense compact than papers formed from coarse fibers. In the following description the term glass fiber may be used for brevity, it being understood that other non-combustible fibers having a low heat conductivity are equally suitable.

Combustible compositions that undergo exothermic reaction without the liberation of any substantial amount of gas are suitable for use in the fuse strips of this invention. In general, such compositions comprise an oxidizable substance and an oxidizing agent, with or without an inert diluent to modify the rate of reaction. For most purposes, I prefer compositions comprising one or more finely divided metals having high heats of combustion as the oxidizable substance, and as the oxidizing agent any of a variety of inorganic substances that react therewith but without liberation of any substantial amount of gas, examples being chlorates, perchlorates and nitrates, particularly of the alkali metals, as well as chromates, iron oxide, manganese dioxide and others. The composition must, of course, be capable of ignition by such means as a percussion primer, match, or the well-known electric matches. Other criteria are that the composition must be stable under normal storage conditions, and preferably have certain ignition at low ambient temperatures. The particular combustible composition to be used will depend upon the desired burning rate of the fuse. The characteristics of these compositions may in general be modified by adding or altering the content of an inert diluent, such, for example, as diatomaceous earth and similar incombustible and non-reactive materials. Many such compositions are wellknown in the art, and by way of illustration, reference may be made to the following compositions that have been found to be satisfactory for the purposes of the invention.

The preferred combustible composition is composed of zirconium metal powder (Zr) and not more than a stoichiometric amount of powdered barium chromate ($BaCrO_4$). This composition readily ignites at low temperatures and the burning rate may be adjusted by varying the proportions of zirconium and barium chromate. A suitable composition having a moderate burning rate contains 18½% Zr and 81½% $BaCrO_4$. A mixture of zirconium metal (Zr) powder (−200 mesh) and powdered red iron oxide ($Fe_2O_3$) in stoichiometric proportions (43.5% Zr, 51.5% $Fe_2O_3$) with 5 per cent by weight of diatomaceous earth as a diluent exhibits fast propagation of combustion.

Another composition is composed of, by weight, 22 per cent nickel (Ni) powder, 5 per cent zirconium (Zr) powder, 16.8 per cent potassium perchlorate (KCl04) and 56.2 per cent barium chromate ($BaCrO_4$). This composition ignites easily at low temperatures and the relative percentages of the four components may be varied over a wide range to give various burning rates. The composition just stated after being compressed at 12,000 psi burns at the rate of 0.1 inch per second, or a burning time of 10 seconds per inch. As exemplifying how the burning characteristics may be varied, if the percentage of zirconium be held constant and the nickel and potassium perchlorate be maintained in substantially stoichiometric ratio, with the barium chromate being varied as a diluent, a burning time of 3 seconds per inch is to be had with 25 per cent of potassium perchlorate and 35.5 per cent each of nickel powder and barium chromate. On the other hand, at approximately 12 per cent of potassium perchlorate, 15 per cent of nickel powder and 67 per cent of barium chromate the burning time is increased to 18 seconds per inch.

When nickel is used in these compositions it is preferred that it be prepared by distillation of mercury (Hg) from a nickel-mercury amalgam as described and claimed in U.S. Pat. No. 1,893,879, issued Jan. 10, 1933, on an application filed by Joseph C. W. Frazer et al. Such nickel powder may be stabilized, if desired, as described and claimed in U.S. Pat. No. 2,487,632, issued Nov. 8, 1949, on an application filed by O. G. Bennett. This form of nickel powder is preferred because it has been found to be much more active in these combustible compositions than nickel produced in any other way. Another composition is one consisting of 9.6 per cent, by weight, of granular aluminum (Al) and the balance barium chromate.

Referring now to FIG. 1, which is an exploded view of the parts of the fuse compact 1, the fuse strip 2 is positioned on backing or insulating strip 4, an unfilled glass fiber paper. The fuse strip and backing strip are maintained wet with water and the fuse strip is conveniently rolled or calendered into the backing strip to hold it in position. A lead strip 6 of combustible composition filled glass fiber paper is positioned in contact with one end of the fuse strip 2 and extends beyond the backing strip. The fuse strip and backing strip are spirally wound around core 8 with the end adjacent to lead strip 6 on the inside of the spiral; the extended portion of the lead strip 6 is folded over the upper face of the core. A second lead strip 10 is contacted with the outer end of the spirally wound fuse strip and a portion 22 extends through slot 12 in insulating disc 14. A primer-disc 16 of glass fiber filled with combustible composition is positioned in the opening 18 of retaining ring 20 and is placed against the lower face of disc 14 in contact with the portion 22 of lead strip. An ignitable disc 24 also formed of glass fiber paper filled with combustible composition in retaining ring 26 is positioned to contact the portion of lead strip 6 which overlies the upper face of core 8. All of the aforementioned parts of the fuse assembly are formed of compressible glass fiber paper; the fuse path, including ignitable disc 24 and primer disc 16, are of glass fiber paper filled with combustible composition.

During assembly, the parts are maintained wet with water, and while wet, the assembly is compressed to form a single consolidated body or compact. The compression is accomplished in any conventional manner, the die having weep holes for discharging water squeezed from the paper. Any compression force may be used that compacts the element into a single consolidated body, e.g. 50–1000 psi. The burning rate of the fuse strip varies considerably depending on the compression pressure; the higher the compression pressure, the lower the burning rate. For example, an uncompressed glass paper strip filled with a composition of 18½% Zr and 81½% $BaCrO_4$ which burns at about 2 inches per second, burns at a rate of 1 inch per second after compression under 750 psi.

Figure 2:
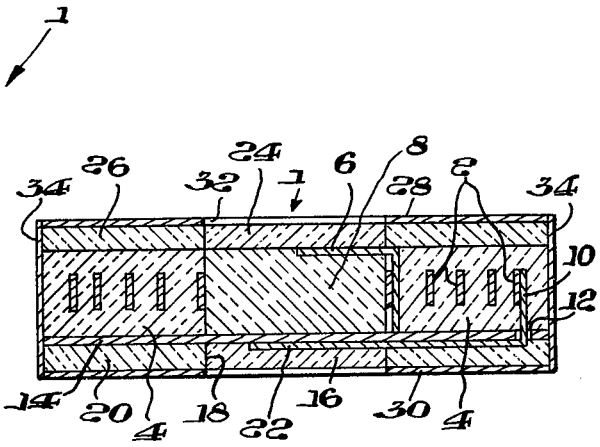
FIG. 2 is a sectional view of the compressed fuse element of FIG. 1 enclosed in a housing.
Figure 3:
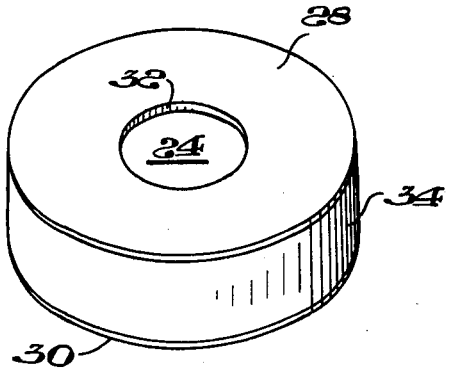
FIG. 3 is a perspective view of the fuse of FIG. 2.

The compressed fuse element is dried at any suitable temperature below the ignition temperature of the combustible composition, and is enclosed in a moisture proof container having openings to expose the ignitable disc 24 and primer disc 16. Preferably, as shown in FIG. 2 and FIG. 3, cover discs 28 and 30 of laminated glassboard having openings 32 are positioned on either end of the fuse compact. The glassboard covers are held in place, and the sides of the fuse compact are protected by a coating of water impermeable resin plastic 34, such as an epoxide resin. The exposed ignitable disc and primer disc are then varnished and dried in the usual manner.

The operation of the time delay fuse is best described with reference to FIG. 2. When the ignitable disc 24 is ignited in any conventional manner, as by electrical match, it ignites lead strip 6 which in turn ignites fuse strip 2. Fuse strip 2 burns linearly at a predetermined rate and in turn ignites lead strip 10 and primer disc 16. The primer disc in turn ignites a blasting cap or other means to set off a main explosive charge. A number of fuse elements may be stacked, the primer disc 16 of the first element will then ignite the ignitable disc 24 of the next fuse element, to provide any desired fuse delay time.

Preferably the ignitable disc 24 and lead strips 6 and 10 are filled with a combustible composition that burns substantially instantaneously, e.g., 67% Zr and 33% $BaCrO_4$, so that the only significant delay occurs in fuse strip 2. Primer disc 16 is also filled with a substantially instantaneous burning composition to provide sure ignition of a charge or another fuse element.

It is apparent to those skilled in the art that fuse elements of any size or shape other than that specifically described herein can be made by the method of this invention, and that several fuse elements can be combined or stacked within a single container to permit assembly of completed fuses with any desired time delay from a stock of only a few sub-assembly fuse elements. Also, the fuses can readily be stacked in a jig or the like in the field to provide any desired time delay.

The following example is illustrative of this invention, wherein an 8.0 second delay fuse is only 0.2 inch thick and 1 7/16 inch in diameter. Fuse strip material was prepared by slurrying 15 g. of chopped superfine glass fiber having an average diameter of between about 0.2 and 0.499 microns in 2¼ liters of water. About 4.5 g. of the fiber was laid down as paper on a 12 inch × 12 inch screen. Sixty-seven grams of $BaCrO_4$ and 15.2 g of Zr were added and mixed with the remaining glass fiber slurry and the resulting slurry was laid down on the screen supported 12 inch × 12 inch glass fiber paper previously laid down to form a sheet of fuse material 0.03 inches thick. The use of an unfilled backing layer is preferred to provide a more flexible fuse material that can be wrapped in very small diameters without breaking. Lead strip material .03 inches thick was similarly prepared, except a 67% Zr - 33% $BaCrO_4$ filler was used.

The ignitable disc and primer disc were formed from a 0.4 inch thick paper containing 25% superfine glass fiber, 37½% ceramic fiber having a composition of approximately 50% alumina and 50% silica and having an average diameter of about 4 microns, and 37½% fine, flexible asbestos fiber, filled with a combustible composition of 67% Zr and 33% $BaCrO_4$. No backing layer is used on the ignitable disc or primer disc material, since these parts must be homogeneous so that they burn on both sides.

The following parts were cut from the appropriate combustible composition filled stock and from superfine glass fiber paper stock of appropriate thickness and assembled as heretofore described: (1) a glass fiber paper backing strip 4, 8.0 inches long, 10/32 inches wide, 0.08 inches thick; (2) a fuse strip 2, 8.0 inches long, 5/32 inches wide and 0.03 inches thick; (3) a glass fiber core 8, ⅜ inches in diameter and 0.3 inches thick; (4) a lead strip 6, 1 inch long, ¼ inch wide and .03 inch thick and a lead strip 10, 2 inches long, ¼ inch wide, and .03 inch thick; (5) a glass fiber paper insulating disc, 14, 1 3/16 inches in diameter and 0.05 inch thick; (6) glass fiber paper annular retaining rings 20 and 26 with an inside diameter of ½ inch, an outside diameter of 1 3/16 inches and a thickness of 0.100 inch; and (7) an ignitable disc 24 and primer disc 16, ½ inch in diameter and 0.4 inches thick. The assembly was compressed at 750 psi and dried to form a compact fuse element 1 3/16 inches in diameter and .15 inch thick. Heat resistant, laminated glassboard annular covers 28 and 30, 1 7/16 inches in diameter and 0.025 inch thick were placed on both faces of the fuse element, coated with epoxide and varnished as heretofore described.

According to the patent statutes, I have explained the principle of my invention and have illustrated and described what I now consider to represent its best embodiment. However, I desire to have it understood that, within the scope of the appended claims, the invention may be practiced otherwise than as specifically described.

I claim:

1. A method of making a time delay fuse comprising the steps of overlaying a fuse strip consisting essentially of a paper formed of non-combustible insulating fibers filled with a combustible composition which evolves substantially no gas on burning with a backing strip wider than said fuse strip consisting essentially of a paper formed from noncombustible insulating fibers, both ends of said fuse strip extending beyond and normal to said backing strip, winding said overlaid fuse strip in a flat spiral around the circumference of a cylindrical core formed from non-combustible insulating fibers to form a cylindrical body having said both fuse strip ends exposed on the surface of said core while maintaining a high water content in said fuse strip, backing strip and core, axially compressing said body to form a compact, and drying said compact.

2. A method of making a time delay fuse comprising overlaying a fuse strip consisting essentially of a paper formed from non-combustible insulating fibers filled with a combustible composition which evolves substantially no gas on burning with a backing strip wider than said fuse strip consisting essentially of a paper formed from non-combustible insulating fibers, both ends of said fuse strip extending beyond said backing strip, winding said overlaid fuse strip on itself to form a body wherein the fuse strip is spaced from itself by said backing strip and both ends of the fuse strip are exposed on the surface of said body while maintaining a high water content in said fuse strip and said backing strip, compressing said body to form a compact and drying said compact.

3. A method of making a time delay fuse comprising the steps of stacking in sequence the following elements: (1) an ignitable disc of non-combustible fiber paper filled with a fast burning combustible composition which evolves substantially no gas on burning situated in an annular disc of non-combustible insulating fiber paper; (2) a core of non-combustible insulating material having spirally wound thereon a fuse strip of non-combustible insulating fiber paper filled with a combustible composition which evolves substantially no gas on burning overlaid with a backing strip of non-combustible insulating fiber paper wider than said fuse strip, the inner end of said fuse strip extending over the lower face of the core and contacting the ignitable disc; (3) a disc of non-combustible insulating fiber paper slotted near its edge, the outer end of the fuse strip extending through the slot and over the upper face of the disc; (4) a primer disc of non-combustible insulating fiber filled with a fast burning combustible composition which evolves substantially no gas on burning situated in an annular disc of non-combustible insulating fiber paper, the primer disc contacting the outer end of the fuse strip; maintaining all the foregoing parts wet with water, axially compressing the stacked elements to form a consolidated cylindrical body, drying the resultant compact and coating the dried compact with a moisture impervious material.

* * * * *